United States Patent [19]

Holford

[11] 3,977,344

[45] Aug. 31, 1976

[54] FLOATABLE CONCRETE STRUCTURES

[76] Inventor: John George Holford, 1350 Winding Trail No. 33, Mississauga, Ontario, Canada

[22] Filed: Oct. 7, 1974

[21] Appl. No.: 512,898

[52] U.S. Cl. ..... 114/.5 F

[51] Int. Cl.[2] ..... B63B 35/00

[58] Field of Search ..... 114/.5 R, .5 F, .5 T, 114/206 R; 461/46, 48

[56] References Cited

UNITED STATES PATENTS

| | | | |
|---|---|---|---|
| 3,091,203 | 5/1963 | Usab | 114/.5 F |
| 3,191,565 | 6/1965 | Filak | 114/.5 F |
| 3,295,153 | 1/1967 | Dessau | 114/206 R |
| 3,442,238 | 5/1969 | Van Oost | 114/.5 F |
| 3,521,588 | 7/1970 | Atlas | 114/.5 F |
| 3,760,754 | 9/1973 | Drummond et al. | 114/.5 F |
| 3,788,254 | 1/1974 | Sheil | 114/.5 F |

*Primary Examiner*—Stephen G. Kunin
*Assistant Examiner*—Jesus D. Sotelo
*Attorney, Agent, or Firm*—Fetherstonhaugh & Co.

[57] ABSTRACT

A floatable concrete structure consisting of at least two modular units of concrete are connected together by post-tensioned cables extending longitudinally therethrough. In one method of assembly floatation units are assembled on dry land, floated in a body of water and thereafter connected by means of the tensioning cables to form a floating concrete structure. Resilient bearing pad is disposed between the abutting end faces of the modular units prior to the tensioning of the cables which connect the modular units.

6 Claims, 11 Drawing Figures

FLOATABLE CONCRETE STRUCTURES

FIELD OF INVENTION

This invention relates to floatable concrete structures and their method of manufacture. In particular, this invention relates to a floating concrete dock and its method of manufacture.

PRIOR ART

The use of concrete in the formation of the structure of the hull of a sailboat or the like is well known. However, these hulls are generally unitary cast structures which are formed on dry land and floated after assembly.

Structures such as floating docks are generally made from wood, metal or plastic material and are costly to manufacture, costly to maintain and readily damaged during docking operations. Wooden and metal structures have a limited working life due to the fact that the wood deteriorates and the metal corrodes through being continually partially submerged in water. In addition, because of the buoyancy of the wood from which floating docks are generally manufactured, wooden docks are generally somewhat unstable. The stability of these wooden docks is also greatly affected by waves in the body of water in which the dock is floating. Waves tend to cause adjacent sections of the floating wooden docks to move relative to one another so that it is not uncommon to find that a floating dock rises and falls a substantial amount under the influence of the waves formed in the body of water in which the dock is floating. This characteristic can make walking on floating wooden docks a hazardous operation. The extent of movement of one section of a dock with respect to an adjacent section resulting from wave formation causes considerable wear on the components of the dock.

In addition, because of the inherent lack of stability in floating wooden dock structures, considerable difficulty is experienced in attempting to anchor docks in a manner such that they will not move under the influence of heavy weather.

In most modern marinas it is desirable to ensure that services such as electrical outlets are provided at each slipway and in most wooden dock structures this is normally achieved simply by means of outdoor insulated cables extended along the dock to each slipway in which an electrical outlet is to be provided. This is an extremely dangerous practice because of the lack of stability in the dock structure and the limited life of the dock structure.

In the assembly of the conventional floating wooden dock structure, it is normal practice to connect each unit by individual bolts extending from one unit to another so that there is no overall rigidifying structure extending throughout the length of the assembly serving to hold the assembly together as a substantially unitary body.

The floating concrete structure of the present invention and its method of assembly overcomes the difficulties of the prior art described above and provides a structure which is longlasting, extremely stable in the water, simple to manufacture and assemble, and readily adapted to accommodate services such as electrical wiring, drinking water, or telephone lines or the like.

It is believed that the use of concrete in floatable composite structures of large mass has not been considered practical because of the nature of the forces which would be applied to adjacent portions of the composite structure by the surface motion of a body of water. If two concrete units were placed in close proximity to one another floating in the body of water the relative movement which is likely to occur between the adjacent concrete units would greatly damage the interface between the units. In land based constructions it is customary to connect the adjacent concrete components by means of a mortar disposed between the abutting faces, the mortar setting so that the units are integrally connected to one another to form a unitary solid structure. This practice could not be conveniently carried out in a method wherein the components of the concrete structure are floated before they are connected.

SUMMARY

It is an object of the present invention to provide a method of forming a floatable concrete structure wherein at least two floatable units of the structure are made from a floatable body of concrete material and are floated in a body of water and thereafter connected to one another by post-tensioned cable means extending therethrough to form a composite floatable concrete structure.

It is a further object of the present invention to provide a floatable concrete structure consisting of two floatable units each consisting of a body of concrete material having a resilient bearing pad disposed between abutting surfaces of the floatable units, the floatable units being connected to one another by means of tensioned cables extending longitudinally therethrough.

A method of forming a floatable concrete structure according to the present invention comprises the steps of: forming at least two floatation units each consisting of a floatable body of concrete material having passage means opening through oppositely disposed spaces thereof, floating the floatable units in a body of water and connecting said two floating units together in an abutting relationship by means of tensioning cables extending through the passage means thereof.

According to a further embodiment of the present invention there is provided a floatable concrete structure comprising at least two floatation units having a resilient bearing pad disposed between abutting surfaces thereof and passage means extending through said floatation units and tensioned cable means extending through said passage means connecting said floatable concrete units to one another with said resilient bearing pad means disposed between the abutting faces thereof.

PREFERRED EMBODIMENT

The invention will be more clearly understood after reference to the following detailed specification read in conjunction with the drawings wherein FIG. 1 is an exploded pictorial view partially in section of a flotation unit according to an embodiment of the present invention;

Figure 1:
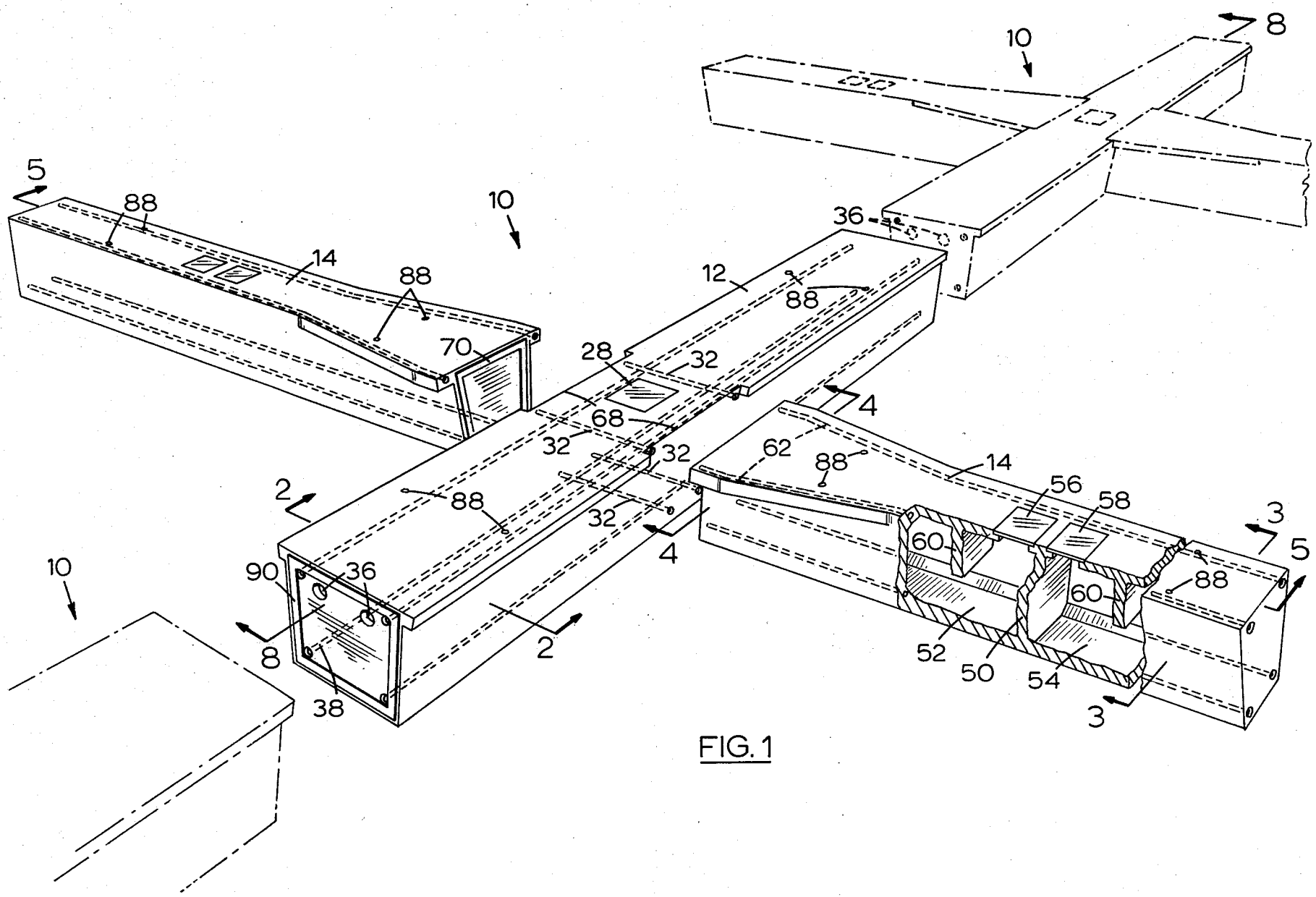
Figure 2:
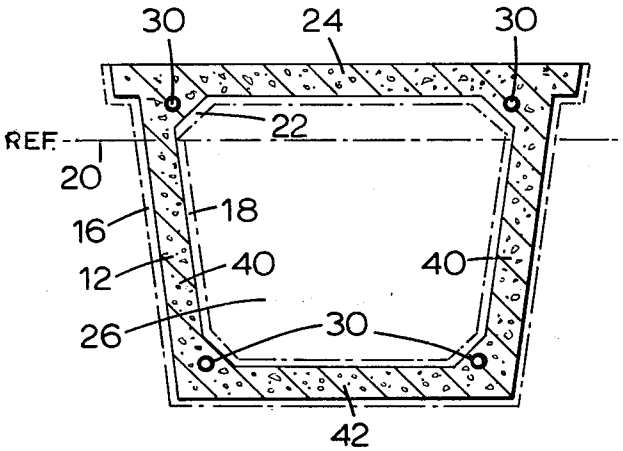
FIG. 2 is a sectional view of a walkway unit taken along the line 2—2 of FIG. 1.

With reference to FIG. 1 of the drawings which illustrates a floating concrete structure in the form of a floating concrete dock according to an embodiment of the present invention, the reference numeral 10 refers generally to a floatation unit which consists of a walkway unit 12 and a pair of slipway units 14. The walkway unit 12 and the slipway units 14 are in the form of hollow concrete bodies which will usually be reinforced with conventional concrete reinforcing elements (not shown) in accordance with conventional concrete forming practice. The concrete bodies are formed according to conventional concrete forming practices. As shown in FIG. 2 of the drawings, an outer mold 16 and an inner mold 18 are arranged to define a chamber therebetween which is filled with concrete to the level of the reference line 20. After the concrete below the level of the reference line 20 has set, the inner mold 18 is removed and an upper support bridge, identified by reference numeral 22 is located within the mold and thereafter the deck portion 24 is cast. Reinforcing webs 25 are cast with the deck portion 24 and project downwardly therefrom into the chamber 26. The webs 25 serve to increase the lateral strength of the units so that they are more capable of resisting ice pressures. An opening 27 extends through each web 25. Access to the chamber 26 which is formed within the body of the walkway unit 12 is provided by means of a centrally located hatch (FIG. 1). During the casting operation plastic sleeves are cast into each of four corners of the assembly to receive tensioning cables as will be described here-in-after. The plastic sleeves 30 extend over the full length of the walkway units 12 and open at opposite end faces thereof. Similar plastic sleeves 32 are cast into the concrete body and extend transversely from one side face to the other at alocation centrally of the length of the walkway unit 12 as illustrated in FIG. 1 of the drawings. Service passages 36 open through the end faces 38 of the walkway unit 12 such that services such as electrical cables or the like may be extended longitudinally through adjacent walkway units over the full length of the assembly. The side walls 40 are downwardly and inwardly inclined in a direction towards the bottom wall 42 so that the bottom wall 42 is narrower than the top deck 24. This downwardly tapered configuration is believed to be of advantage in that it serves to render the structure more capable of withstanding pressures generated by the formation of ice in the body of water in which the dock is floating.

A further feature which serves to resist ice damage is the fact that the depth of imersion of each walkway unit 12 and each slipway unit 14 is preferably of the order of about three feet, which is generally greater than the thickness of ice experienced in most areas. As a result, floating dock structures of the type of the present invention need not be removed at the end of each boating season in most localities where boating is a popular sport.

Figure 4:
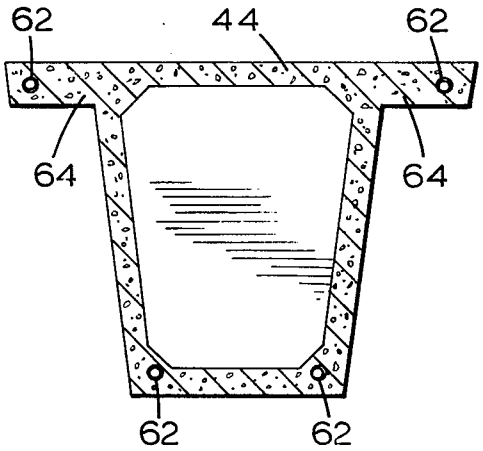
FIG. 4 is a sectional view of a slipway unit taken along the line 4—4 of FIG. 1.
Figure 3:
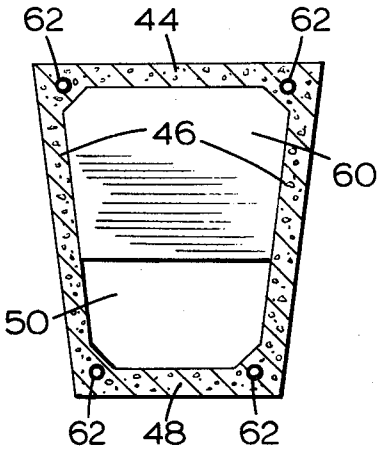
FIG. 3 is a sectional view of a slipway unit taken along the line 3—3 of FIG. 1.

The slipway units 14 are formed from concrete in a manner similar to that described with respect to the walkway units 12 and each have an upper deck 44, a pair of oppositely disposed side walls 46 and a bottom wall 48 and a central divider wall 50 which together form a pair of isolated flotation chambers 52 and 54. Access to the chamber 52 is provided by way of access hatch 56 and access to the chamber 54 is provided by way of access hatch 58. Reinforcing walls 60 are also cast into the body of the slipway units. In addition, plastic cleeves 62 are cast into the concrete body of each walkway unit and extend longtudinally there through and open at opposite ends thereof. As shown in FIGS. 1 and 4 of the drawings, the upper deck 44 has a greater width adjacent the inner end of the body and provides flange portions 64 which increases the effective width of the upper deck of the slipway portions at the inner ends thereof. This practice is an adaptation of the practice which is presently used in the construction of wooden docks to provide an upper deck which conforms substantially to the shape of the hull of a boat to be docked there beside.

The passages formed in the sleeves 62 are aligned with the passages formed in the sleeves 32 at the inner end of the slipway unit 14.

The inner end wall 66 (FIG. 5) of the slipway units 14 are angularly inclined so as to be parallel with the side walls 40 of the walkway unit. The upper edge of the walkway unit is notched as at 68 (FIG. 1) to permit the end walls 66 to engage the side walls 40 in a close abutting relationship. A resilent bearing pad or gasket 70 made of rubber or the like is secured to the end face 66 of each walkway unit. The bearing pad 70 acts to form a structural joint between abutting ends of the units and serves to accomodate variations in the dimension of the concrete units and prevents excessive local crushing of the concrete at the abutting ends. Without the resilient bearing pad 70 the loads applied to the assembly could cause self destruction of the concrete.

Figure 7:
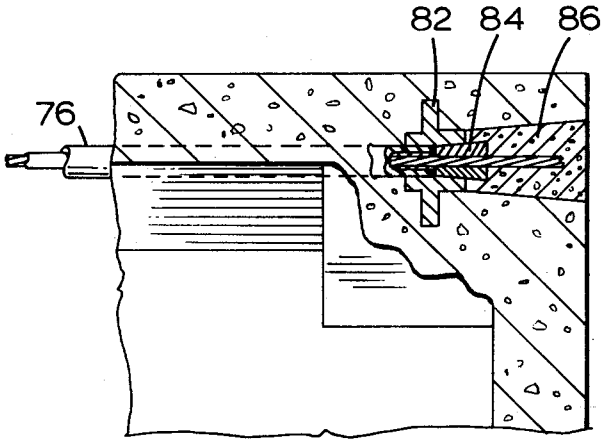
FIG. 7 is an enlarged view of the portion of the assembly encircled at 7 in FIG. 5.
Figure 6:
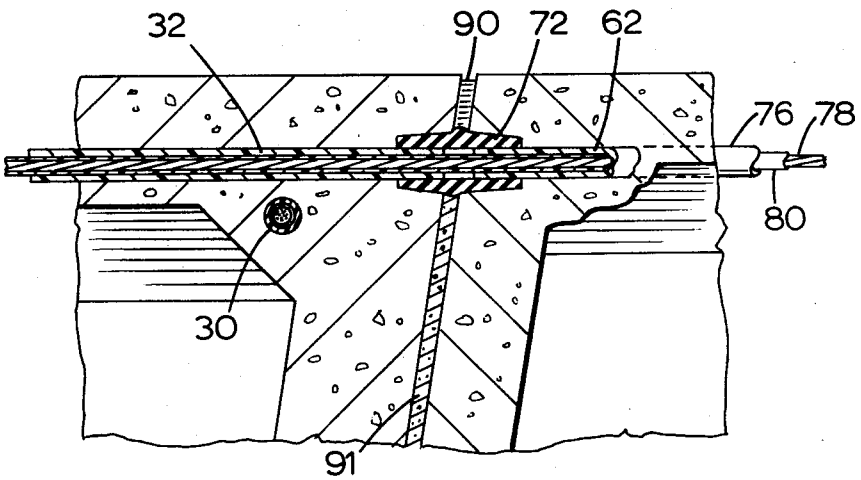
FIG. 6 is an enlarge view of the portion of the assembly encircled at 6 in FIG. 5.
Figure 8:
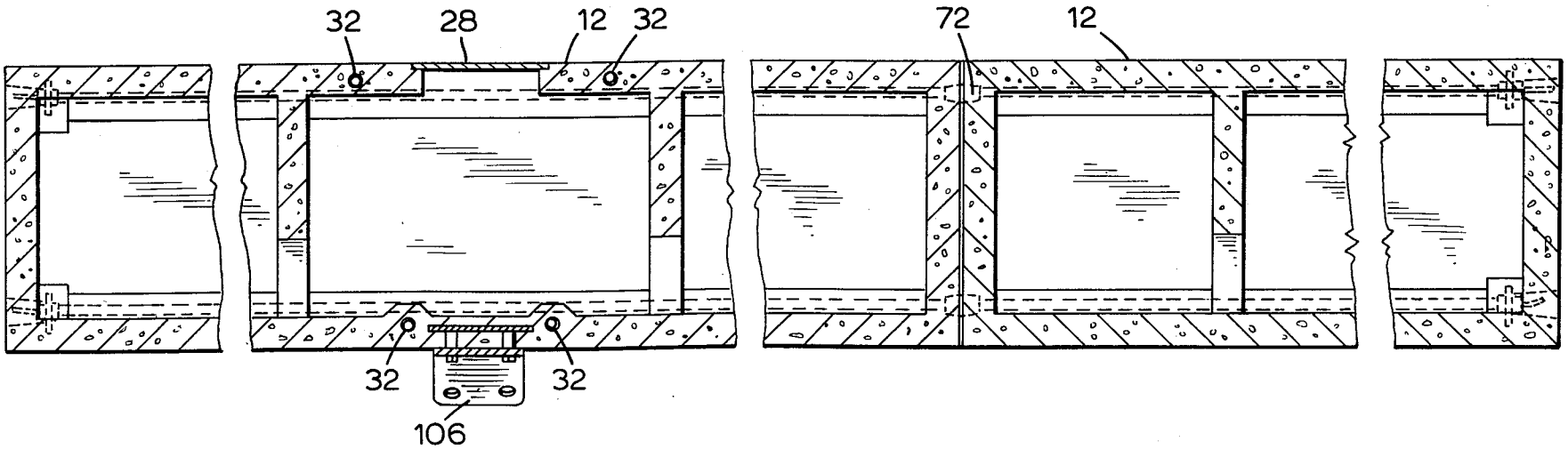
FIG. 8 is a longitudinal sectional view taken along the line 8—8 in FIG. 1

A floatation unit consisting of one walkway unit 12 and one 14 therebetween or two slipway units 14 are assembled on dry land with resilent pressure pads. As shown in FIG. 6 of the drawings, a grommet or strand protector 72 is made of rubber or the like is located in the opposite disposed ends of the passages formed about the ends of the plastic sleeves 32 and 62. These grommets serve to permit limited alignment adjustments. The two slipway units are brought into engagement with the side faces of the walkway unit and concrete structure tensioning cables 76 are threaded through the passages formed in the sleeves 62 and 32. The cables 76 are prefereably standard concrete tensioning cables consisting of a metal inner core 78 and an outer plastic sheath 80. The cables are tensioned by means of a hydraulic tensioning unit (now shown) in a manner which is common practice in the construction industry and they are anchored at opposite ends in anchor plates 82 (FIG. 7) by means of wedge blocks 84. The open ends of each of the tension passages are then filled with concrete to form end closure 86. A plurality of floatation units 10 of the type described above or of the type in which only one slipway unit is secured to a walkway unit are formed on dry land as previously described. These units are then floated. In order to facilitate the floating of these units, threaded metal insert 88 are cast into the body of both the walkway unit 12 and the slipway units 14 to which eyebolts (not shown) may be secured so that the floatation unit may be raised by a dock-side crane or the like as an assembled unit and lowered into the water.

Figure 9:
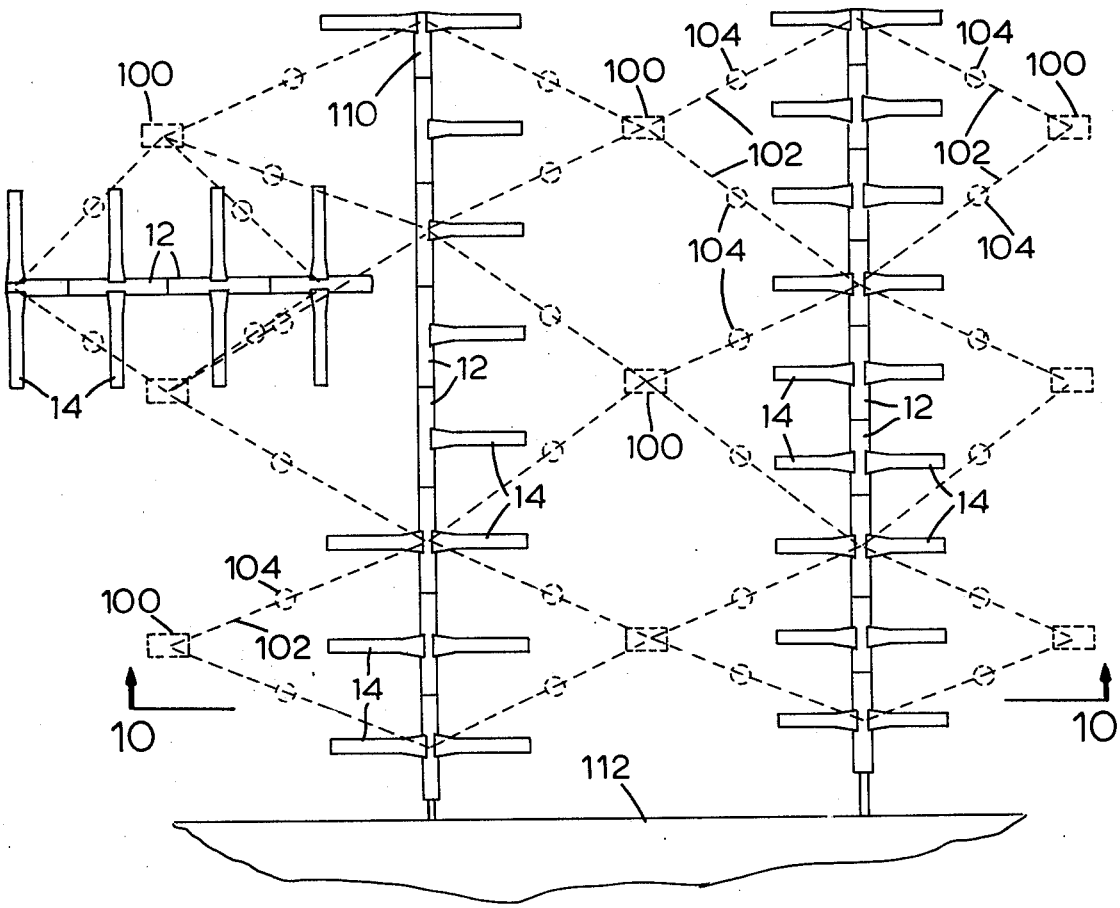
FIG. 9 is a diagrammatic plan view illustrating the manner in which a plurality of floatation units are assembled and anchored.
Figure 10:
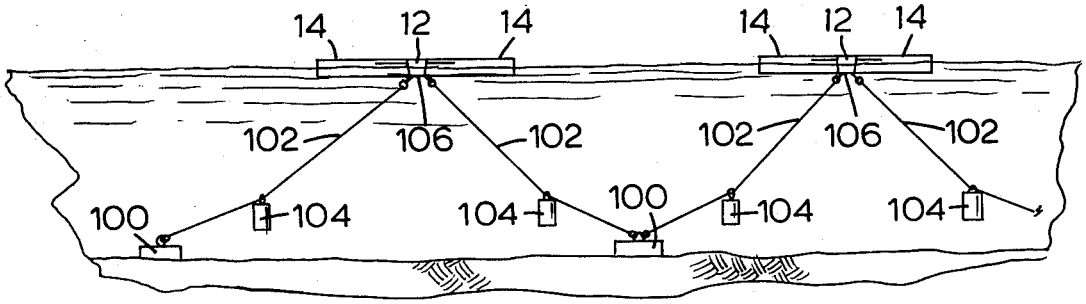
FIG. 10 is a diagrammatic illustration taken along the line 10—10 of FIG. 9.
Figure 11:
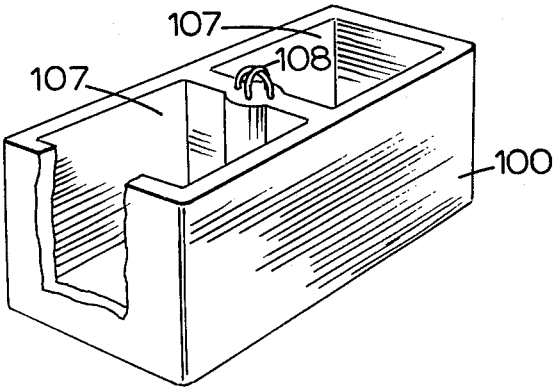
FIG. 11 is a pictorial view of an anchor weight according to an embodiment of the present invention.

A gasket 90 of rubber or the like is secured at each end wall 38 of each walkway unit. When two or more floatation units are required to form a floating dock, the end walls of the walkway units are floated into an abutting relationship and tensioning cables are extended through the passages formed in the sleeves 30 of the abutting walkway units. As shown in FIG. 9 of the drawings as many as ten or more walkway units may be aligned in this manner with tensioning cables extending continuously through the aligned sleeves 30. The cables are tensioned and anchored as previously described with respect to the connection of the slipway units to the walkway units. It has been found that an access chamber may be attached to the floating outer most ends of the assembly, the attachment being pumped free of water to remove water from the ends of the floating units during the tensioning and anchoring of the tensioning cables.

Figure 5:
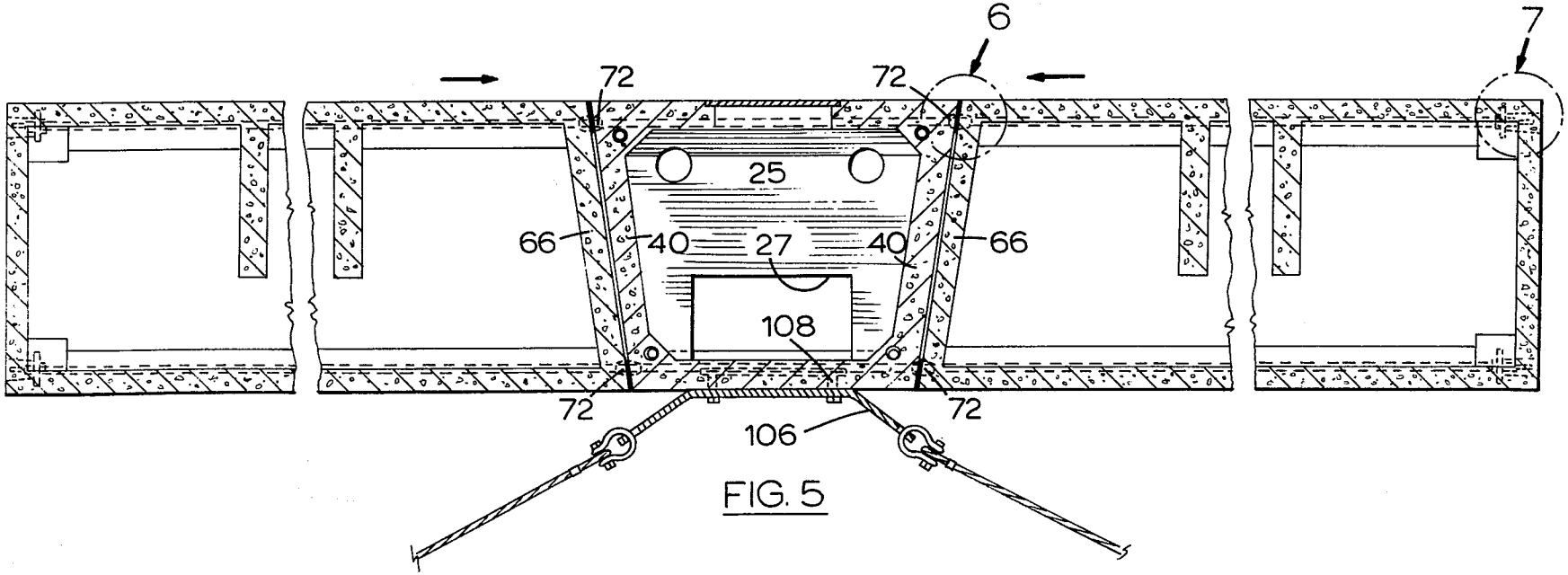
FIG. 5 is a sectional view of an assembled floatation unit taken along the line 5—5 of FIG. 1.

As shown in FIG. 9 of the drawings, a docking area may employ any number of docking units each consisting of a plurality of floatation units connected together and anchored with respect to the body of water by means of anchors 100, anchor cables 102, and anchor weights 104. An anchor plate 106 may be bolted onto the underside of each of the walkway units centrally of the length thereof by means of suitable studs 108 cast into the structure of the body of the walkway unit (FIG. 5). It has been found that a stable floating dock may be achieved by locating anchors 100 on opposite sides of each floating dock assembly approximately centrally of the distance between two spaced apart walkway units and by connecting the walkway unit cables 102 to the floating docks in a diamond-shaped pattern with an anchor weight 104 carried by each cable at a level above the bed of the body of water.

The anchor 100 is preferable in the form of a concrete structure having chambers 107 opening outwardly from the upper surface thereof. These chambers are flooded in order to sink the anchor and may be filled with sand, or concrete blocks or the like. Coupling rods 108 are cast into the structure of the weight 100 for use in connecting the weight 100 to the cables 102.

As shown in FIG. 9 of the drawings, terminal walkway units 110 may be formed which differ from the standard walkway units 12 in that they do not extend beyond the point of connection of the slipway units 14. There terminal units 110 are shaped similar to the terminal units which are formed in the construction of a wooden floating dock unit.

Tests have shown that a floating dock unit constructed as described above is extremely stable and, in fact, under normal wave conditions in a marina sheltered by a breakwater, the users of these docks are not aware of the fact that the dock is actually floating and tend to think that the dock is, in fact, supported by piles extending upwardly from the underlying bed of the body of water.

Various modifications of the present invention will be apparent to those skilled in the art without departing from the scope of the invention. For example, the walkways and slipways may have a somewhat different shape or configuration depending upon the application and manner of use of the units. As previously described, some of the walkway units may be of the terminal units such as those identified by the reference numeral 110. In an other modification a solidifying grouting material, such as a cement mortar may be loaded into the space formed inwardly of the gasket 90 as shown at 91 in FIG. 6 the grouting material solidifying to connect the abutting units and thereby strengthen and stiffen the assembly.

The provision of the passages 36 opening longitudinally through the end walls of each of the walkway units permits electrical wiring and other services, including water, telephone and the like to extend over the full length of the assembled floating dock in a location which is spaced from the walking upper surfaces of the dock. It will be understood that the passages 36 in the endmost walkway unit are suitably plugged to prevent water entering the hollow chamber formed within the walkway unit.

There are two features of the present invention which have previously been described with respect to the structure as it is applied to a floating dock which are of particular importance in the construction of floatable concrete structures of various different types. In one preferred method of the present invention the principal feature resides in the practice of floating concrete bodies which are no longer than can be readily assembled on dry land and thereafter connecting these bodies to form a much larger body the assembly of which on dry land would be extremely difficult. By reason of the fact that the components are floating when they are connected it is quite easy to thread tensioning cables therethrough for the purpose of aligning the components and securing the components together.

A further important feature of the present invention is the provision of a resilient bearing pad between the abutting faces of the floatable concrete units which are connected together by means of the post-tensioned cables. This pad prevents the concrete face of one unit being drawn against the concrete face of an abutting unit during the assembly. Irregularities in the surface contour of abutting concrete units is highly likely and such irregularities would cause localized crushing forces to be applied to the various high points so that the body of the concrete at the high points would be crushed during the tensioning operation thereby damaging the structure. The resilient bearing pad preferably measures about an inch in thickness and serves to accomodate limited relative movement which might occur between the adjacent concrete units.

It will be apparent that various floating concrete structures may conveniently be assembled by using the same modular construction and post tensioning procedure. For example a floating concrete bridge may be made from modular units which are connected together by post tension cables to form a floating bridge assembly. The floating bridge may then be elevated to test on permanent mounting in the manner of a conventional bridge if required. This method of the present invention can therefor form a preliminary step in the method of forming a structure which is difficult to manipulate onto position on dry land. Similar floating concrete airfield, construction platform, exploration platforms, weatherstations on the like may be produced. In addition this method may be employed in the manufacturing of floating vessels such as segmental barges on the like. These and other concrete structures may be manufactured by the method of the present invention.

It will be apparent that while there is a substantial advantage in assembling the floating units of the present invention after they have been floated in a body of water the advantages to be obtained from the use of floatable concrete components and the post tensioning method of connecting them may be obtained in applications where the units are totally assembled on dry land and thereafter floated. This process may be carried out in tidal areas where an incoming tide may be used to float the assembly. Alternatively this structure may be assembled in a dry dock which is then floated to float the assembly. While these and other techniques are possible it should be noted however that there is a substantial advantage in the preferred method wherein the flotation units are floated in the body of water before they are connected. In a further application the assembled structure may be floaded to sink or to be submerged as required in use.

What I claim as my invention is:

1. A floating concrete dock comprising, a. a plurality of walkway units each consisting of a hollow buoyant body of concrete material having an upper surface, a lower surface, a pair of oppositely disposed end faces and a pair of oppositely disposed side faces and a water line disposed adjacent said upper surface, first passage means extending through each unit and opening through said side faces thereof at at least one location along the length thereof and second passage means extending longitudinally thereof and opening through said end faces, said first passage and second passage means each including upper passage means disposed adjacent said upper surface and lower passage means disposed below said water line adjacent said lower surface, b. a plurality of modular slipway units each consisting of a hollow buoyant body of concrete material having an upper surface and a lower surface and oppositely disposed end and side faces, and a water line disposed adjacent said upper surface, first passage means extending through each slipway unit and opening through said oppositely disposed end faces, said first passage means of said slipway including upper passage means disposed adjacent said upper surface and lower passage means disposed below said water line adjacent said lower surface, c. first tensioning cable means extending through said passage means of each slipway unit and said first passage means of an associated walkway unit, said cable means being tensioned and anchored with respect to a slipway unit and its associated walkway unit to secure them together and prevent relative movement therebetween in a vertical plane, d. second tensioning cable means extending through said second passage means of each of said walkway units, said second tensioning cable means being tensioned and anchored with respect to said walkway units to secure them together and prevent relative movement therebetween in a vertical plane.

2. A floating concrete dock as claimed in claim 1 wherein two slipway units are connected by said tensioned cable means to each walkway unit in the formation of said floatation units, each of said two slipway units extending from opposite sides of said walkway and being aligned with one another to form slipways on opposite sides of said walkway.

3. A floating concrete dock as claimed in claim 1 wherein service passage means is formed in the abutting ends of said walkway units, said walkway units being connected to a source of services through service line means extending through said service passage means and hollow interior of each walkway unit and hatch means opening into each walkway unit to provide access to the hollow interior thereof for the installation and maintenance of said service lines.

4. A floating concrete dock as claimed in claim 1 wherein resilient sealing means is provided between each abutting face of said modular unit, said sealing means being disposed outwardly from said upper and lower passage means to form a continuous seal thereabout.

5. A floating concrete dock as claimed in claim 1 wherein said slipway units and said walkway units are each formed with a maximum width at their uppermost faces tapering to a minimum width at their lowermost faces.

6. A floating concrete dock as claimed in claim 1 wherein said first and second passage means each consist of four separate passages spaced a substantial distance from one another.

* * * * *